United States Patent [19]

Johansson et al.

[11] Patent Number: 5,008,076

[45] Date of Patent: Apr. 16, 1991

[54] METHOD AND AN ARRANGEMENT FOR THE PRETREATMENT OF A MOVING MATERIAL WEB

[75] Inventors: Göran Johansson, Harlösa; Pär Olanders, Lund, both of Sweden

[73] Assignee: Roby Teknik Aktiebolag, Lund, Sweden

[21] Appl. No.: 346,658

[22] Filed: May 3, 1989

[30] Foreign Application Priority Data

May 31, 1988 [SE] Sweden ..... 8802019

[51] Int. Cl.[5] ..... A61L 2/00

[52] U.S. Cl. ..... 422/28; 422/292; 422/302; 422/304; 53/167; 53/425

[58] Field of Search ..... 422/26, 27, 28, 33, 422/38, 292, 293, 295, 296, 297, 300, 301, 302, 304; 53/425, 426, 167; 134/15, 64 R

[56] References Cited

U.S. PATENT DOCUMENTS

| | | | |
|---|---|---|---|
| 3,436,265 | 4/1969 | Gardner | 134/15 |
| 3,692,468 | 9/1972 | Loliger et al. | 53/167 |
| 3,884,012 | 5/1975 | Ernsisson et al. | 53/167 |
| 3,911,640 | 10/1975 | Rausing | 53/167 |
| 3,954,406 | 5/1976 | Chamberlain | 422/27 |
| 4,014,158 | 3/1977 | Rausing | 53/167 |
| 4,104,024 | 8/1978 | Vogele et al. | 134/15 |
| 4,225,556 | 9/1980 | Lothman et al. | 422/28 |
| 4,396,582 | 8/1983 | Kodera | 53/167 |
| 4,594,748 | 6/1986 | Warfvinge | 134/15 |

*Primary Examiner*—Robert J. Hill, Jr.
*Assistant Examiner*—William H. Beisner
*Attorney, Agent, or Firm*—Burns, Doane, Swecker & Mathis

[57] ABSTRACT

A method of treating a moving material web that is to be used in the fabrication of aseptic packages includes heating the material web prior to inserting the web into a heated bath of sterilizing agent so that when the web is inserted into the bath, the temperature of the web is at least equal to the temperature of the heated bath. The apparatus for carrying out that method includes a heating arrangement that is connected to a container that contains the heated bath of sterilizing agent. The container is positioned after the heating arrangement in the direction of movement of the material web. The heating arrangement includes a box and nozzles extending inwardly from the inner sides of the box. The nozzles are connected to a source of hot air and are adapted to blow hot air on both sides of the material web for heating the web.

15 Claims, 1 Drawing Sheet

METHOD AND AN ARRANGEMENT FOR THE PRETREATMENT OF A MOVING MATERIAL WEB

FIELD OF THE INVENTION

The present invention relates to a method and apparatus for the pretreatment of a material web. More particularly, the present invention relates to a method and apparatus for pretreating a packing laminate that is to be used in the fabrication of sterilized packing containers. Also a metal foil, this web for the purpose of sterilization being brought into contact with a sterilizing agent by passing the web through a heated bath containing the said agent. The invention also relates to an arrangement for the realization of the method.

BACKGROUND OF THE INVENTION

It is known that so-called aseptic packages can be produced by packing sterilized contents into sterilized packing containers under controlled aseptic conditions. A known aseptic package of non-returnable character is manufactured with the help of a packing machine which produces packages from a web of laminated packing material. The longitudinal edges of the web are combined with one another so as to form a tube which is filled with the intended, sterilized contents and which is divided into sealed container units through repeated flattening and sealing of the tube along narrow zones located transversely to the tube. After separation by means of cuts in the sealing zones and possible fold-forming and sealing, the container units leave the machine in the form of finished packages of usually parallelepipedic shape.

To ensure that the sterilized contents introduced preserve their sterility in the package, the web, or at least the side of the web which is intended to be facing towards the inside of the tube, must be sterilized before it comes into contact with the contents. The sterilization of the web is usually performed by bringing the web into contact with a chemical sterilizing agent by passing the web through a heated bath containing the sterilizing agent. Thereafter, any excess sterilizing liquid is squeezed out of the web with the help of cooperating pressure rollers between which the web is conducted. Remaining residual amounts of sterilizing liquid are driven off the web with the help of hot air which is blown towards one or both sides of the web. The web is then converted to a tube with the sterilized inside ready to receive the particular sterilized contents.

Through use of hydrogen peroxide, which is an example of a frequently used sterilizing agent on an aseptic packing machine of the type described, it has been found that bacteriological killing effects, which fully comply with prescribed health conditions, are achieved if the sterilizing agent is used in the form of a solution containing approx. 35% hydrogen peroxide ($H_2O_2$) at a temperature of approx. 65°–75° C., preferably approx. 70° C. However the contact between the material web and the sterilizing solution must be maintained at least for a certain specified time. Assuming a normal production speed of a conventional packing machine, the aforementioned contact time corresponds to a certain contact distance, which implies that the bath containing the sterilizing solution, must belong enough to provide an accessible pass-through distance for the moving material web that corresponds to contact distance. For practical reasons, such as the lack of space, the bath frequently is arranged in the form of a so-called deep bath, moreover the bath is located in a vertical container arranged before the forming and filling zone of the tube, whose height appreciably exceeds its width. The material web which is to be sterilized is then passed in a vertical loop through the bath and around a roller arranged in the lower part of the container. The roller helps control the moving material web so that at any time each part of the web is below the liquid level and is in contact with the sterilizing solution during a period, calculated from the entry of the web into the bath to the web's exit from it, that corresponds at least to the required contact time. A further advantage gained by using this deep bath is that good contact between the material passing through the bath and the sterilizing solution in the bath is ensured, at least in the lower part of the container where the contact is intensified as a result of the prevailing higher hydrostatic pressure which presses the sterilizing solution towards the passing web.

The intensified contact between the hydrogen peroxide solution and the material web is, of course, an advantages from a point of view of bacteriological killing. However, the intensified contact also increases the risk that the hydrogen peroxide solution will penetrate into and degrade the liquid-absorbent fibrous layer of the material web through cut edges of the web. This risk, which is connected with the hydrostatic pressure in the bath and consequently increases at the same rate as the rate of increase in the hydrostatic static pressure, is aggravated somewhat also by the fact that the material web in the known sterilization system before it enters into the bath has a temperature that corresponds to ambient temperature which in any case is appreciably lower than the temperature of the heated sterilization bath (approx. 65°–75° C.), this means that after entering the bath the relatively colder material web will pass through a certain part of the bath during which the web absorbs heat from the surrounding hydrogen peroxide solution as a result the solution is cooled down before temperature equilibrium between the hydrogen peroxide solution and the web has been reached. As mentioned previously, the bacteriological killing effect is dependent, among other things, on the temperature of the hydrogen peroxide solution. Thus in order to compensate for the less active bacteria-killing contact stretch, through which the material web is liable to pass before the required equilibrium of temperature between the hydrogen peroxide solution and the material web has been able to establish itself, it has been necessary to "overdimension" the bath somewhat. That is to say it has been necessary to design the bath to be deeper than would be the case if this temperature equilibrium had established itself instantaneously upon entry of the web into the bath. The overdimensioning of the bath results in a further increase in hydrostatic pressure as well as an increase in the risk that the liquid will penetrate into the web in the deeper parts of the bath, alternatively, the bath can be made wider but that anternative requires more space.

OBJECTS AND SUMMARY OF THE INVENTION

The method described above of sterilizing a packing material web by using a heated bath containing a chemical sterilizing agent, in particular hydrogen peroxide, can be improved, however, if the web is subjected to a heat treatment prior to passage through the bath more particularly, it has been found in accordance with the present invention that substantial advantages are gained if during such a preceding heat treatment the web is heated to such an extent that the temperature of the web on entry into the bath reaches, or slightly exceeds, the actual bath temperature.

If, as proposed in accordance with the present invention, the material web is preheated so that its temperature at least corresponds to, or slightly exceeds, the actual bath temperature when the web enters the bath, the zones of the bath less active from a of bacteriological killing point of view such as described earlier are reduced or even wholly eliminated, and safe preconditions are established to ensure that no negative temperature balance between the material web and the hydrogen peroxide solution is created in any part of the heated bath. As a result, the bath does not have to be overdimensioned by being made deeper and/or wider, but in practice can be designed to have the minimum dimensions which are required so as to achieve, under the given preconditions concerning temperature and concentration of the hydrogen peroxide solution, the desired bacteriological killing effect after a given minimum time in the bath.

By preheating the material web so that its temperature on entry into the bath is even a few degrees higher than the actual bath temperature, it has been found that the bath can be made even smaller, particularly more shallow, than what would be required, for example, if the temperature of the web were to correspond exactly to the bath temperature. Moreover the bacteriological killing effect of the bath is not impaired. This is due to the fact that such an exaggerated preheating brings about an improved killing effect owing to the fact that bacteria on the material web at these high temperatures (70°-90° C.) are dried out to a certain extent. And consequently become more sensitive to the effect of the hydrogen peroxide solution.

The proposed preheating of the material web, especially if the web is made of a packing material consisting of plastic-coated paper, entails the further advantage that readily volatile, nonpolarized or incompletely polymerized monomers which can be found in, and which accompany, the plastic coatings of the material web, and which may impart an unpleasant taste to, or in some other manner affect, the contents of the subsequently produced packing containers, are evaporated and removed from the material web. This expulsion of readily volatile, taste-impairing plastic components can be made more effective still by subjecting the material web during the preheating step to a simultaneous evacuation, as a result of which plastic paper dust and dust of any other kind is pulled off the material web and is thus prevented from accompanying the web down into the hydrogen peroxide solution where it could contaminate the solution.

BRIEF DESCRIPTION OF THE DRAWINGS

The invention will be described in more detail in the following with special reference to the attached drawings, wherein like elements bear the reference numerals and wherein.

DETAILED DESCRIPTION OF THE PREFERRED EMBODIMENT

Figure 1:
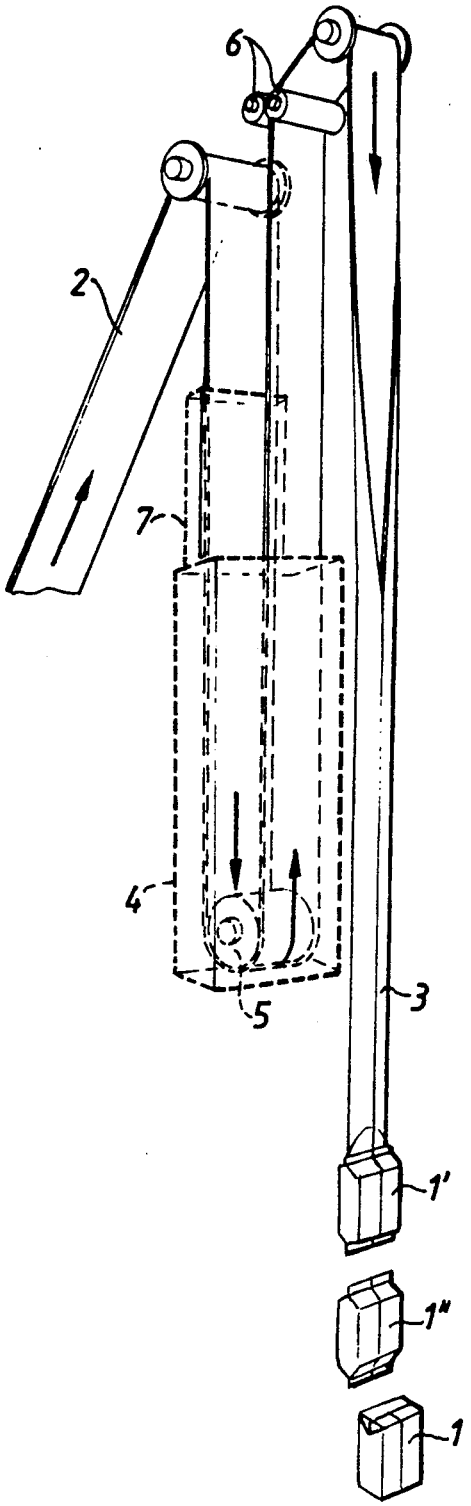
FIG. 1 is a schematic illustration of the method in accordance with the invention for manufacturing so-called aseptic packing containers; well known in itself.

In accordance with the priciple of manufacture illustrated summarily in FIG. 1, aseptic packing containers 1 are manufactured, as described earlier, with the help of a conventional packing machine which from a web 2 produces packages in which the two longitudinal edges of the web are joined to one another to form a downwardly growing tube 3 which via a product filling pipe (not shown) inserted through the upper open end of the tube is filled with the particular, sterile-treated contents. The tube 3 is divided into closed, cushion-liked container repeated flattenings and transverse seals at right angles to the longitudinal axis of the tube. The container units 1 which, thereafter, are separated from one another by cuts in the sealing the units zones and after appropriate fold-forming and sealing leave the machine in the form of finished, aseptic packages 1 of usually parallelepipedic shape. As mentioned earlier in order for the finished packages 1 to be aseptic the contents as well as the web must be sterilized prior to contact with one another, and the tube-forming and filling operations themselves must be carried out under conditions which prevent infection of the sterilized packing material and contents.

The sterilization of the contents usually is done by means of heat treatment during which the contents are heated according to a given temperature/time scheme. The aseptic environment is maintained by carrying out the tube forming and filling operation of the machine in a casing excluding the environment within which a certain pressure is maintained which effectively prevents the penetration of nonsterile ambient air. The pressure is maintained by introducing hot air into the casing.

The sterilization of the material web 2 is carried out, as closely to the tube-forming and filling zone of the machine as possible the web 2 is brought into contact with a liquid, chemical sterilizing agent which in the embodiment shown in FIG. 1 is arranged in the form of a so-called deep bath in a vertical container 4 shown by broken lines. The web 2 is conducted in a vertical loop around a roller 5 provided in the lower part of the bath 4. The container 4, as is clearly evident from FIG. 1, has a height dimension which appreciably exceeds the corresponding width dimension of the container in the horizontal plane across the direction of movement of the material web 2.

In the example chosen here it is assumed that the material web 2 consists of a laminated material comprising a base layer of paper or cardboard with outer layers of thermoplastics, preferably polythene, and one or more layers of other material, e.g. metal foil or plastics of a type different from that mentioned here, arranged between the plastic and base layer. For example the packing material may have the following conventional composition, from the outside of the web to its inside: LDPE/paper or cardboard/LDPE/Al-foil/LDPE. The foregoing material having good tightness properties against liquid, gases and light and, moreover, is easy to seal by means of conventional so-called heat sealing. In the example chosen it is assumed, moreover, that the chemical sterilizing agent consists of an approx. 30-50 w/v % hydrogen peroxide solution heated to approx. 65°-75° C., e.g. 70° C., and that the container 4 containing the peroxide is dimensioned so that each part of the material web 2 passing through at the actual speed of the machine is in contact sufficiently long with the hydrogen peroxide solution in the bath to achieve an acceptable bacteriological killing effect.

From the container 4 the web mixed with hydrogen peroxide is passed through the nip between two mangle rollers 6, by means of which excess hydrogen peroxide solution is mechanically squeezed out of the web and is returned down into the container 4. The web then travels further up into the tube forming and filling zone of the machine. Upon entering the forming and filling zone, the web on entering passes a number of nozzles directed towards the inside of the web. Hot air is blown through the nozzles for remaining amounts of hydrogen peroxide before the material web is converted to the tubular shape.

In accordance with the present invention a heating region 7 indicated by broken lines is provided before the deep bath, in the direction of movement of the material web as indicated by the arrows, through which the web 2 is conducted for combined conditioning and heating prior to entry into the bath. Within the region 7, as is shown in more detail in FIG. 2, there is a substantially rectangular box 8, whose upper end has a narrow inlet gap 9 adapted to receive the web and whose lower end is open and connected tightly to the top of the container 4 in the region before entry of the web into the bath. Along the sides 8a of the box there are a number of nozzles 10, evenly distributed in the transverse as well as in the longitudinal direction and directed towards both sides of the web. The nozzles 10, which 16, are in communication with a source of hot air 18 via 16, a common duct direct the hot air emanating directly towards both sides of the web, as indicated by the solid arrows in FIG. 2. In the immediate vicinity of the gap-like inlet opening 9 of the box 8 the latter is provided with an expanded portion 11 serving as an evacuation chamber with a constricted, gaplike inlet opening 12 and connecting means 14 joined to the evacuation chamber 13 and located preferably on either side of the web 2, the connecting means 14, 15 are in communication with a source of vacuum, 17 via a duct 15.

Figure 2:
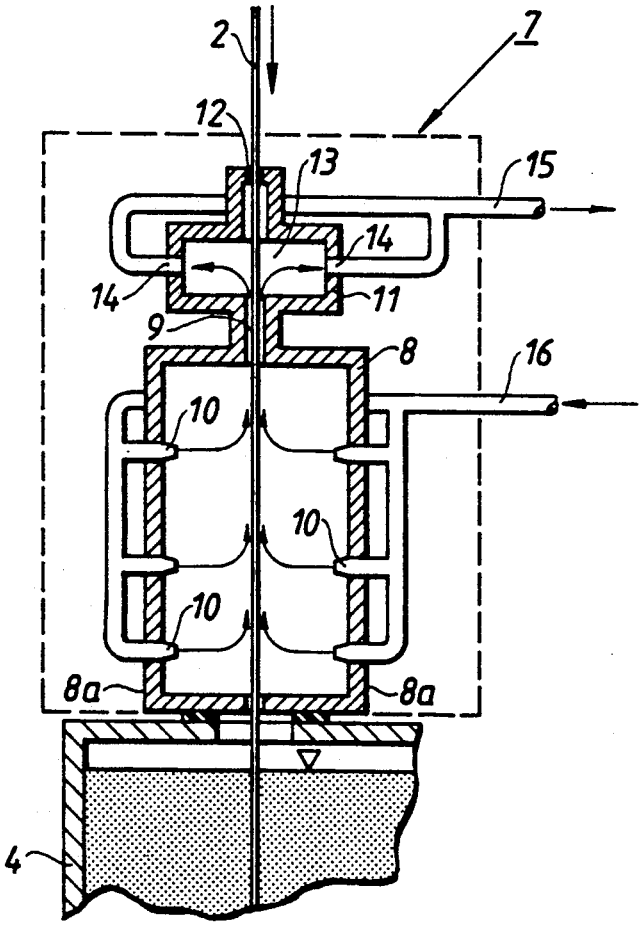
FIG. 2 is a cross-sectional view of a portion of the apparatus used in the method of the present invention.

During the passage through the box 8 within the conditioning and heating region 7 shown in FIG. 2 the web 2 will pass a stream of hot air emanating from the nozzles 10, which owing to the partial vacuum, maintained in the evacuation chamber 13, is directed in counterflow to the web and is brought into intensive contact with both sides of the web within the region of the narrowly designed gap opening 9, as a result of which an effective heating of the web, or at least of the outer plastic coatings of the web, is obtained as a result of the heating, any readily volatile components which may impart an unpleasant taste are liberated from the plastic coatings, are entrained by the counterflowing air stream and are evacuated through the connecting means 14. This air stream is also able to remove to a certain extent fibre and plastic dust which is also extracted through the evacuating connecting means 14 and is thus prevented from accompanying the web 2 down into the sterilizing bath where it could contaminate the bath.

A heating arrangement of the type just described, with the help of which it is thus possible to preheat as well as clean the web prior to its entry into the subsequent sterilizing bath, has been found to be particularly advantageous in the sterilization of packing material webs comprising layers of paper or cardboard and plastics, but it is likewise possible, of course, within the framework of the general basic concept underlying the invention, to use other types of heating arrangements in order to provide the desired preheating of the material web which, for the purpose of sterilization, is intended to be passed through a liquid sterilizing agent.

While this invention has been illustrated and described in accordance with a preferred embodiment, it is recognized that variations and changes may be made and equivalents employed herein without departing from the invention as set forth in the claims.

What is claimed is:

1. A method for sterilization of a moving material web comprising the steps of:
   - providing a deep bath containing sterilization liquid heated to a predetermined temperature;
   - guiding the material web into and out of the bath in a continuous manner; and
   - applying heat to the material web prior to its entry into the bath containing the heated sterilizing liquid by advancing, the material web through a heating chamber to raise the temperature of the material web to a temperature that is at least equal to said predetermined temperature.

2. The method according to claim 1, including the step of simultaneously exposing the material web to vacuum conditions during said heat applying step.

3. The method according to claim 1, wherein said predetermined temperature is between about 65° C. and about 75° C. and said sterilizing agent is a 35 w/v % hydrogen peroxide solution.

4. The method according to claim 1, wherein said predetermined temperature is about 70° C.

5. The method according to claim 1 wherein said material web is heated to between about 70° C. and about 90° C.

6. The method according to claim 1, wherein said step of applying heat to the material web includes blowing hot air towards both sides of the material web as the material web advances toward the sterilization bath.

7. The method according to claim 1, wherein said heating chamber is connected to a heat source, and including a step of advancing the material web through an evacuation chamber prior to advancing the material web through the heating chamber, said evacuation chamber being connected to a source of vacuum and to said heating chamber.

8. The method according to claim 1, wherein said material web is heated to a temperature greater than said predetermined temperature.

9. A method for treating a moving material web comprising the steps of:
   - guiding the material web in a continuous manner into and out of a container containing a bath of sterilization liquid heated to a predetermined temperature;
   - raising the temperature of the moving material web to at least said predetermined temperature prior to its entry into the bath by continuously advancing the moving material web through a heating arrangement that includes an evacuation chamber and a box which is connected to the evacuation chamber and to the container, said evacuation chamber being connected to a source of vacuum and said box being connected to a source of hot air so that as the material web is continuously advanced through the heating arrangement, the hot air is drawn into the evacuation chamber from the box in a direction opposite to the direction of movement of the moving material web.

10. The method according to claim 9, wherein the temperature of said material web is raised to a temperature that is greater than said predetermined temperature.

11. An apparatus for treating a moving material web comprising:

a heating arrangement; and a container connected to said heating arrangement and positioned downstream from the heating arrangement in the direction of movement of the material web so that the material web is conveyed through the heating arrangement and then through the container, said container containing a deep bath of heated sterilizing agent that has been heated to a predetermined temperature, said heating arrangement including heating means for heating the material web to a temperature that is at least equal to said predetermined temperature as the material web is conveyed through the heating arrangement so that when the material web enters the bath of sterilizing agent, the temperature of the material web is at least equal to the temperature of the sterilizing agent.

12. The apparatus according to claim 11, wherein said heating arrangement includes a rectangular box having an inlet, an outlet and an interior, and said heating means includes nozzles and a source of hot air, wherein said nozzles are connected to the source of hot air for heating the material web as it passes between the nozzles, said nozzles extending from opposite inner sides of the box towards the interior of the box.

13. The apparatus according to claim 12, including a source of vacuum and wherein said heating arrangement includes an enclosure that is connected to the inlet of said box, said enclosure being connected to the source of vacuum so that the enclosure defines an evacuation chamber, the inlet of said box being a narrow opening for producing intensive contact of the hot air with the material web as the hot air is drawn through the narrow inlet in a direction opposite to the direction of movement of the web as a result of the operation of the source of vacuum.

14. An apparatus for treating a moving material web comprising:

a heating arrangement that includes a box having a narrow inlet, an oppositely positioned outlet, and an interior, said heating arrangement also including an evacuation chamber connected to the inlet of the box and heating means connected to the interior of the box for delivering hot air to the box, said apparatus including a source of vacuum, said evacuation chamber being connected to the source of vacuum; and a container containing a bath of sterilizing liquid heated to a predetermined temperature, said container being connected to the outlet of the box and being positioned downstream from the box in the direction of movement of the moving material web, said heating means directing hot air into the interior of the box so that as the material web moves through the evacuation chamber, the narrow inlet and the box, the hot air will be drawn into the evacuation chamber in a direction opposite to the direction of movement of the material web and will be brought into intensive contact with the material web to thereby heat the material web to a temperature that is at least equal to said predetermined temperature.

15. The apparatus according to claim 14, wherein said heating means includes a source of hot air which is connected to a plurality of nozzles positioned on opposite sides of said box for directing streams of hot air to opposite sides of the material web.

* * * * *